US006036048A

United States Patent [19]

Fischman

[11] Patent Number: 6,036,048

[45] Date of Patent: Mar. 14, 2000

[54] BEVERAGE CONTAINER WITH SELF-CONTAINED STRAW

[76] Inventor: Fagey L. Fischman, 5401 Bellaire Dr., New Orleans, La. 70124

[21] Appl. No.: 09/085,871

[22] Filed: May 28, 1998

[51] Int. Cl.[7] ..... B65D 47/06

[52] U.S. Cl. ..... 220/706; 220/709; 220/710; 215/388

[58] Field of Search ..... 220/709, 706, 220/710; 215/388

[56] References Cited

U.S. PATENT DOCUMENTS

| | | | |
|---|---|---|---|
| 4,305,521 | 12/1981 | Komatsuta et al. | 220/706 |
| 5,080,247 | 1/1992 | Murphy et al. | 220/706 |
| 5,244,112 | 9/1993 | Murphy et al. | 220/706 |
| 5,431,297 | 7/1995 | Rosello | 220/706 |
| 5,788,106 | 8/1998 | Hotinski | 220/709 |
| 5,819,979 | 10/1998 | Murphy et al. | 220/706 |

*Primary Examiner*—Joseph M. Moy

[57] ABSTRACT

A new Beverage Container With Self-Contained Straw for providing a more convenient and sanitary way to consume a canned beverage. The inventive device includes a container body including a bottom and a top with a drink opening therein, a tubular guide member extending upward from the bottom of the container body in vertical alignment with the drink opening, and a buoyant drinking straw positioned within and extending upward from the tubular guide member wherein the buoyant drinking straw is self-extendable through the drink opening when the drink opening is opened.

13 Claims, 2 Drawing Sheets

10
20
21
22
23
24
25
26
27
30
31
32
40
41
42
46
47
L
C
3
4

BEVERAGE CONTAINER WITH SELF-CONTAINED STRAW

BACKGROUND OF THE INVENTION

1. Field of the Invention

The present invention relates to beverage containers and more particularly pertains to a new Beverage Container With Self-Contained Straw for providing a more convenient and sanitary way to consume a canned beverage.

2. Description of the Prior Art

The use of beverage containers is known in the prior art. More specifically, beverage containers heretofore devised and utilized are known to consist basically of familiar, expected and obvious structural configurations, notwithstanding the myriad of designs encompassed by the crowded prior art which have been developed for the fulfillment of countless objectives and requirements.

Known prior art beverage containers include U.S. Pat. No. 5,431,297; U.S. Pat. No. 5,253,779; U.S. Pat. No. 5,188,283; U.S. Pat. No. 5,385,264; U.S. Pat. No. 5,437,389; and U.S. Pat. No. D334,503.

While these devices fulfill their respective, particular objectives and requirements, the aforementioned patents do not disclose a new Beverage Container With Self-Contained Straw. The inventive device includes a container body including a bottom and a top with a drink opening therein, a tubular guide member extending upward from the bottom of the container body in vertical alignment with the drink opening, and a buoyant drinking straw positioned within and extending upward from the tubular guide member wherein the buoyant drinking straw is self-extendable through the drink opening when the drink opening is opened.

In these respects, the Beverage Container With Self-Contained Straw according to the present invention substantially departs from the conventional concepts and designs of the prior art, and in so doing provides an apparatus primarily developed for the purpose of providing a more convenient and sanitary way to consume a canned beverage.

SUMMARY OF THE INVENTION

In view of the foregoing disadvantages inherent in the known types of beverage containers now present in the prior art, the present invention provides a new Beverage Container With Self-Contained Straw construction wherein the same can be utilized for providing a more convenient and sanitary way to consume a canned beverage.

The general purpose of the present invention, which will be described subsequently in greater detail, is to provide a new Beverage Container With Self-Contained Straw apparatus and method which has many of the advantages of the beverage containers mentioned heretofore and many novel features that result in a new Beverage Container With Self-Contained Straw which is not anticipated, rendered obvious, suggested, or even implied by any of the prior art beverage containers, either alone or in any combination thereof.

To attain this, the present invention generally comprises a container body including a bottom and a top with a drink opening therein, a tubular guide member extending upward from the bottom of the container body in vertical alignment with the drink opening, and a buoyant drinking straw positioned within and extending upward from the tubular guide member wherein the buoyant drinking straw is self-extendable through the drink opening when the drink opening is opened.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Beverage Container With Self-Contained Straw apparatus and method which has many of the advantages of the beverage containers mentioned heretofore and many novel features that result in a new Beverage Container With Self-Contained Straw which is not anticipated, rendered obvious, suggested, or even implied by any of the prior art beverage containers, either alone or in any combination thereof.

It is another object of the present invention to provide a new Beverage Container With Self-Contained Straw which may be easily and efficiently manufactured and marketed.

It is a further object of the present invention to provide a new Beverage Container With Self-Contained Straw which is of a durable and reliable construction.

An even further object of the present invention is to provide a new Beverage Container With Self-Contained Straw which is susceptible of a low cost of manufacture with regard to both materials and labor, and which accordingly is then susceptible of low prices of sale to the consuming public, thereby making such Beverage Container With Self-Contained Straw economically available to the buying public.

Still yet another object of the present invention is to provide a new Beverage Container With Self-Contained Straw which provides in the apparatuses and methods of the prior art some of the advantages thereof, while simultaneously overcoming some of the disadvantages normally associated therewith.

Still another object of the present invention is to provide a new Beverage Container With Self-Contained Straw for providing a more convenient and sanitary way to consume a canned beverage.

Yet another object of the present invention is to provide a new Beverage Container With Self-Contained Straw which includes a container body including a bottom and a top with a drink opening therein, a tubular guide member extending upward from the bottom of the container body in vertical alignment with the drink opening, and a buoyant drinking straw positioned within and extending upward from the tubular guide member wherein the buoyant drinking straw is self-extendable through the drink opening when the drink opening is opened.

Still yet another object of the present invention is to provide a new Beverage Container With Self-Contained Straw that would enable a consumer to more easily drink from a beverage container.

Even still another object of the present invention is to provide a new Beverage Container With Self-Contained Straw that would eliminate the need for consumers to place their lips directly on a beverage container, which may be dirty.

Even still another object of the present invention is to provide a new Beverage Container With Self-Contained Straw that would eliminate the need to wash the top of a beverage container before drinking therefrom.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1A, 1B, 2:
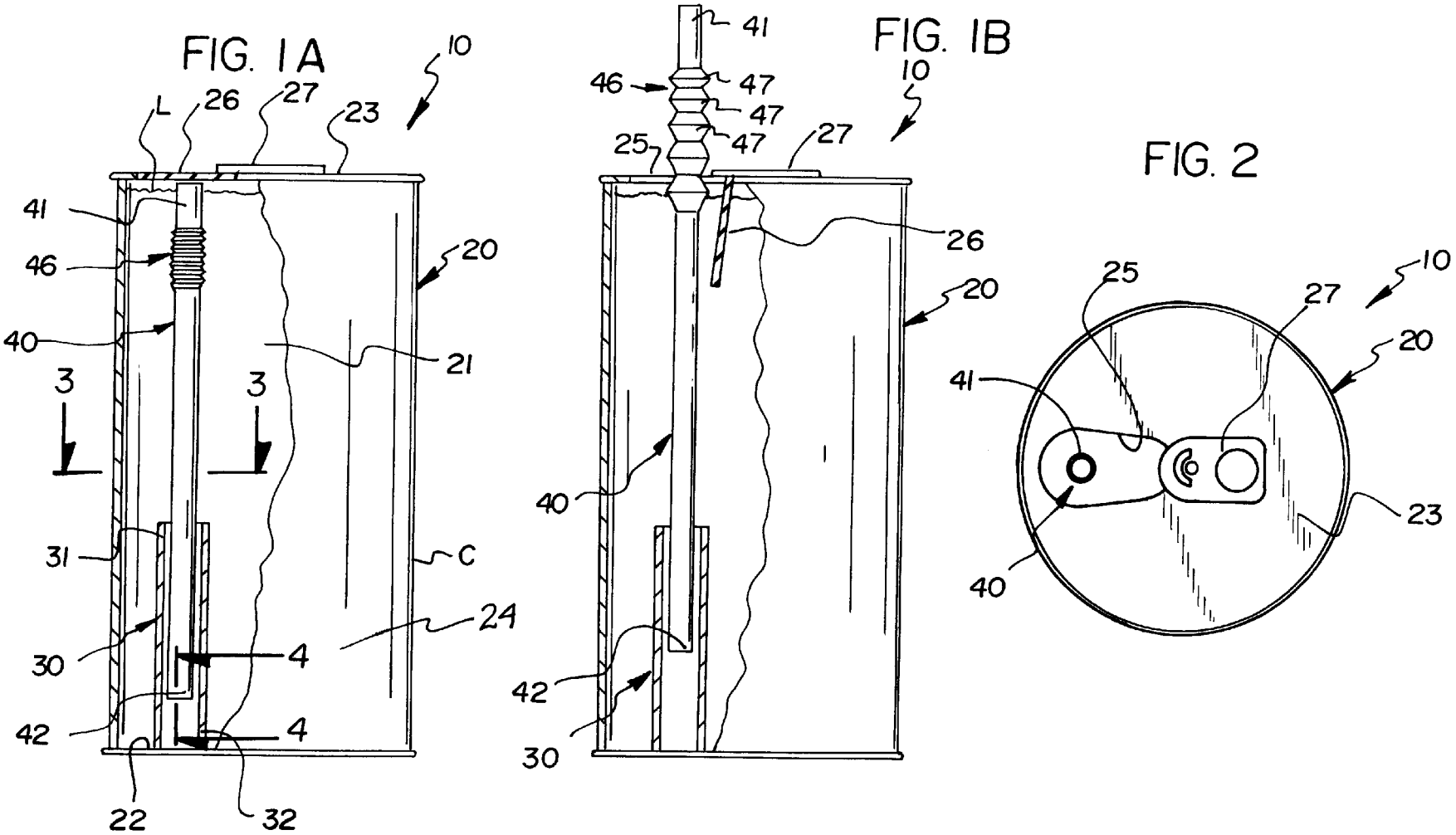
FIGS. 1A and 1B are cut-away side views of a new Beverage Container With Self-Contained Straw in unopened and opened configurations, respectively, according to the present invention.
FIG. 2 is a top view of the present invention in the opened configuration.

With reference now to the drawings, and in particular to FIGS. 1 through 4 thereof, a new Beverage Container With Self-Contained Straw embodying the principles and concepts of the present invention and generally designated by the reference numeral 10 will be described.

As best illustrated in FIGS. 1 through 4, the Beverage Container With Self-Contained Straw 10 comprises a container body 20 including a bottom 22 and a top 23 with a drink opening 25 therein, a tubular guide member 30 extending upward from the bottom 22 of the container body 20 in vertical alignment with the drink opening 25, and a buoyant drinking straw 40 positioned within and extending upward from the tubular guide member 30 wherein the buoyant drinking straw 40 is self-extendable through the drink opening 25 when the drink opening 25 is opened.

Figure 3:
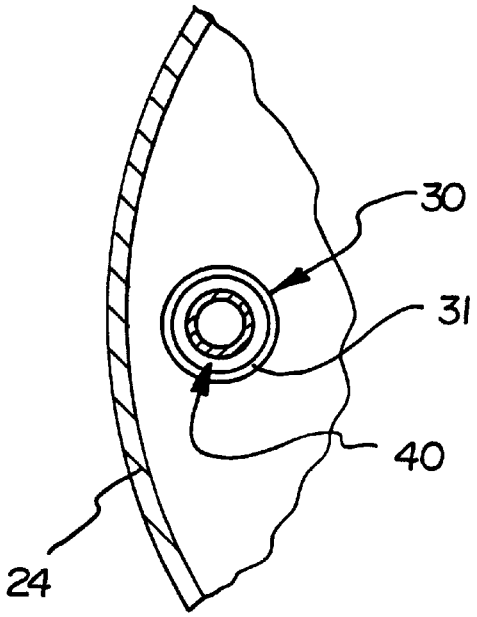
FIG. 3 is a top view from the perspective of line 3—3 of FIG. 1A.
Figure 4:
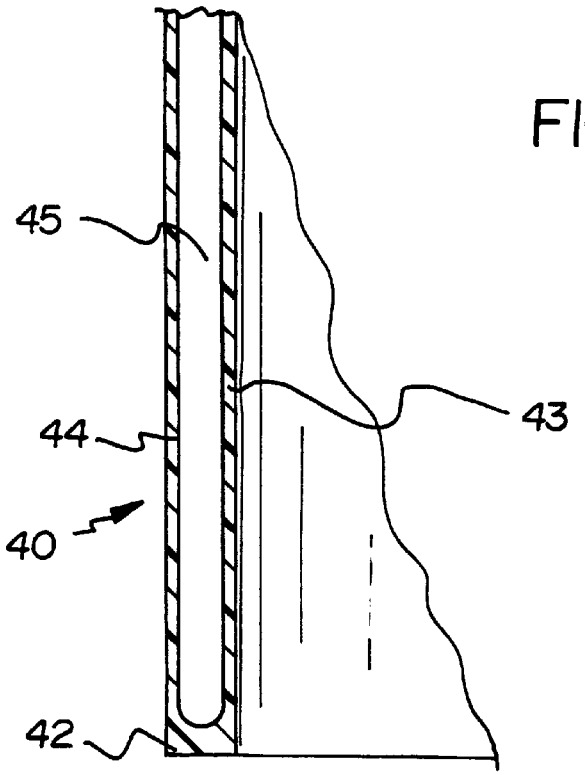
FIG. 4 is a cross sectional view taken along line 4—4 of FIG. 1A.

In a preferred embodiment, best illustrated in FIGS. 1 through 3, the container body 20 is a cylindrical can C and includes a circular bottom wall 22, a circular top wall 23 having a drink opening 25 therein, and a tubular side wall 24 extending between and sealingly joined with the circular bottom wall 22 and the circular top wall 23 to define an interior volume 21 for containing a liquid L. The circular top wall 23 has a drink opening 25 therein and includes a punch-out portion 26 sealingly removably disposed within the drink opening 25. An opening tab 27 is mounted on the circular top wall 23 adjacent the punch-out portion 26 wherein the opening tab 27 is movable to remove the punch-out portion 26 and open the drink opening 25.

The tubular guide member 30 has an upper end 31 and a lower end 32 wherein the lower end 32 is secured to the circular bottom wall 22 of the container body 20. The tubular guide member 30 extends upward from the circular bottom wall 22 of the container body 20 within the interior volume 21 thereof. The tubular guide member 30 is positioned on the circular bottom wall 22 in vertical alignment with the drink opening 25 provided in the circular top wall 23. The tubular guide member 30 has an inner diameter sufficient for vertically positioning of the buoyant drinking straw 40 therein. In a preferred embodiment, the tubular guide member 30 is of a height less than half of the height of the container body 20. More specifically, in an illustrative embodiment, the height of the tubular guide member 30 is in the range of about 0.5 inches to about 2.5 inches.

The buoyant drinking straw 40 has an upper end 41 and a lower end 42 wherein the lower end 42 is positioned and vertically oriented within the tubular guide member 30. As such, the upper end 41 of the buoyant drinking straw 40 extends above the tubular guide member 30 in vertical alignment with the drink opening 25 provided in the circular top wall 23 of the container body 20. In a preferred embodiment, best illustrated in FIG. 4, the buoyant drinking straw 40 is formed of an inner tubular wall 43 and an outer tubular wall 44 surrounding and spaced from the inner tubular wall 43. Accordingly, the inner tubular wall 43 and the outer tubular wall 44 are cooperatively joined to form an air pocket 45 therebetween whereby the buoyant drinking straw 40 floats in the liquid L contained within the interior volume 21 of the container body 20.

As best illustrated in FIGS. 1A and 1B, the buoyant drinking straw 40 is of a length less than the height of the container body 20 so as to fit vertically oriented within the container body 20 when the drink opening 25 is unopened. Accordingly, in a preferred embodiment, the buoyant drinking straw 40 includes an expandable and collapsible portion 46 adjacent the upper end 41 thereof. The expandable and collapsible portion 46 comprises a plurality of interconnected bellows segments 47. As such, the buoyant drinking straw 40 may be extended whereby the upper end 41 of the buoyant drinking straw 40 extends through the drink opening 25 and above the circular top wall 23 when the drink opening 25 is opened and the lower end 42 of the buoyant drinking straw 40 is in contact with the circular bottom wall 22. In addition, the expandable and collapsible portion 46 allows the buoyant drinking straw 40 to bend easily whereby the upper end 41 may be angled and directed toward the user thereof.

In use, the drink opening 25 is opened with the opening tab 27. Thereafter, the upper end 41 of the buoyant drinking straw 40 self-extends through the drink opening 25. Accordingly, the expandable and collapsible portion 46 of the buoyant drinking straw 40 is expanded. Consequently, the upper end 41 of the buoyant drinking straw 40 extends sufficiently above the circular top wall 23 of the container body 20 when the lower end 42 contacts the circular bottom wall 22. As such, the user may place his or her lips around the upper end 41 of the buoyant drinking straw 40 and drink the liquid L contained within the interior volume 21 of the container body 20.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A beverage container with self-contained straw, comprising:

a container body including a bottom and a top having a drink opening therein;

a tubular guide member extending upward from said bottom of said container body in vertical alignment with said drink opening; and a buoyant drinking straw positioned within and extending upward from said tubular guide member;

said drinking straw having an inner tubular wall and an outer tubular wall, said outer tubular wall surrounding said inner tubular wall and being positioned in spaced relationship to said inner tubular wall, said inner tubular wall and said outer tubular wall cooperatively joined to form an air pocket therebetween whereby said buoyant drinking straw has a density less than that of a liquid contained within said container body whereby said buoyant drinking straw is self-extendable through said drink opening when said drink opening is opened.

2. The beverage container of claim 1, wherein said tubular guide member has an inner diameter sufficient for vertical positioning of said buoyant drinking straw therein.

3. The beverage container of claim 1, wherein said tubular guide member is of a height less than half of the height of said container body.

4. The beverage container of claim 1, wherein said tubular guide member is of a height in the range of about 0.5 inches to about 2.5 inches.

5. The beverage container of claim 1, wherein said buoyant drinking straw is of a length less than the height of said container body whereby said buoyant drinking straw may be vertically oriented within said container body when said drink opening is unopened.

6. The beverage container of claim 1, wherein said buoyant drinking straw includes an expandable and collapsible portion adjacent an upper end thereof whereby said buoyant drinking straw may be lengthened.

7. The beverage container of claim 6, wherein said expandable and collapsible portion comprises a plurality of interconnected bellows segments.

8. A beverage container with self-contained straw, comprising:

a container body including a circular bottom wall, a circular top wall having a drink opening therein, and a tubular side wall extending between and sealingly joined with said circular bottom wall and said circular top wall to define an interior volume for containing a liquid, said circular top wall having a drink opening therein and including a punch-out portion removably sealing said drink opening;

an opening tab mounted on said circular top wall of said container body adjacent said punch-out portion, said opening tab movable to remove said punch-out portion and open said drink opening;

a tubular guide member having an upper end and a lower end, said lower end of said tubular guide member secured to said circular bottom wall of said container body whereby said tubular guide member perpendicularly extends upward from said circular bottom wall of said container body within said interior volume thereof, said tubular guide member positioned in vertical alignment with said drink opening provided in said circular top wall; and a buoyant drinking straw having an upper end and a lower end, said lower end positioned and vertically oriented within said tubular guide member, said upper end of said buoyant drinking straw extending above said tubular guide member in vertical alignment with said drink opening provided in said circular top wall of said container body;

drinking straw having an inner tubular wall, and an outer tubular wall, said outer tubular wall surrounding said inner tubular wall and being positioned in spaced relationship to said inner tubular wall, said inner tubular wall and said outer tubular wall cooperatively joined to form an air pocket therebetween whereby said buoyant drinking straw has a density less than that of a liquid contained within said container body whereby said buoyant drinking straw is self-extendable through said drink opening when said drink opening is opened.

9. The beverage container of claim 8, wherein said tubular guide member is of a height less than half of the height of said container body.

10. The beverage container of claim 9, wherein said height of said tubular guide member is in the range of about 0.5 inches to about 2.5 inches.

11. The beverage container of claim 8, wherein said buoyant drinking straw is of a length less than the height of said container body whereby said buoyant drinking straw may be vertically oriented within said container body when said drink opening is unopened.

12. The beverage container of claim 8, wherein said buoyant drinking straw includes an expandable and collapsible portion adjacent said upper end thereof whereby said buoyant drinking straw may be lengthened.

13. The beverage container of claim 12, wherein said expandable and collapsible portion comprises a plurality of interconnected bellows segments.

* * * * *